US005269407A

United States Patent [19]

Hall

[11] Patent Number: 5,269,407

[45] Date of Patent: Dec. 14, 1993

[54] PANTYHOSE STORAGE CONTAINER

[76] Inventor: Patricia A. Hall, 845 Indian Wells Cir., Elgin, Ill. 60123

[21] Appl. No.: 993,370

[22] Filed: Dec. 18, 1992

[51] Int. Cl.[5] ..... B65D 85/18; B65H 16/02

[52] U.S. Cl. ..... 206/225; 206/279; 206/292; 220/757; 220/764; 220/768; 242/55.53

[58] Field of Search ..... 206/407, 408, 389, 225, 206/278, 279, 292, 293, 294, 804; 220/752, 755, 757, 762, 764, 765, 768; 242/67.1 R, 55.53

[56] References Cited

U.S. PATENT DOCUMENTS 1,841,266 1/1932 Jones ..... 206/408 X
4,639,386 1/1987 Akao ..... 206/389 X
4,925,022 5/1990 Hodges ..... 206/278 X
5,181,670 1/1993 Eaton et al. ..... 242/67.1 R

*Primary Examiner*—Steven N. Meyers
*Assistant Examiner*—Jacob K. Ackun, Jr.
*Attorney, Agent, or Firm*—Leon Gilden

[57] ABSTRACT

A storage container addressed to the folded storage and securement of pantyhose for transport and storage includes a cylindrical housing to receive an insert having spaced first and second plates, with the first and second plates including first and second ribs arranged in a parallel relationship relative to one another and orthogonally oriented relative to and between the first and second plates, wherein the ribs are arranged to receive and store a furled pair of flexible pantyhose and the like within the housing.

3 Claims, 4 Drawing Sheets

PANTYHOSE STORAGE CONTAINER

BACKGROUND OF THE INVENTION

1. Field of the Invention

The field of invention relates to storage apparatus, and more particularly pertains to a new and improved pantyhose storage container for the storage and transport of pantyhose in a safe and secure manner.

2. Description of the Prior Art

Storage apparatus of various types are utilized throughout the prior art, wherein the instant invention attempts to address deficiencies in the prior art by providing for a container arranged for the safe and sanitary storage of additional pantyhose in a manner to prevent damage.

The instant invention maintains the pantyhose in a furled relationship within the storage container and prevents the access to the pantyhose of various objects and the like tending to damage the pantyhose due to the typically fragile nature of the pantyhose relative to sharp objects and the like and in this respect, the present invention substantially fulfills this need.

SUMMARY OF THE INVENTION

In view of the foregoing disadvantages inherent in the known types of storage apparatus now present in the prior art, the present invention provides a pantyhose storage container wherein the same is arranged to receive and secure a pair of pantyhose in a furled relationship within the container. As such, the general purpose of the present invention, which will be described subsequently in greater detail, is to provide a new and improved pantyhose storage container which has all the advantages of the prior art storage apparatus and none of the disadvantages.

To attain this, the present invention provides a storage container addressed to the folded storage and securement of pantyhose for transport and storage, including a cylindrical housing to receive an insert having spaced first and second plates, with the first and second plates including first and second ribs arranged in a parallel relationship relative to one another and orthogonally oriented relative to and between the first and second plates, wherein the ribs are arranged to receive and store a furled pair of flexible pantyhose and the like within the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pantyhose storage container which has all the advantages of the prior art storage apparatus and none of the disadvantages.

It is another object of the present invention to provide a new and improved pantyhose storage container which may be easily and efficiently manufactured and marketed.

It is a further object of the present invention to provide a new and improved pantyhose storage container which is of a durable and reliable construction.

An even further object of the present invention is to provide a new and improved pantyhose storage container which is susceptible of a low cost of manufacture with regard to both materials and labor, and which accordingly is then susceptible of low prices of sale to the consuming public, thereby making such pantyhose storage containers economically available to the buying public.

Still yet another object of the present invention is to provide a new and improved pantyhose storage container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
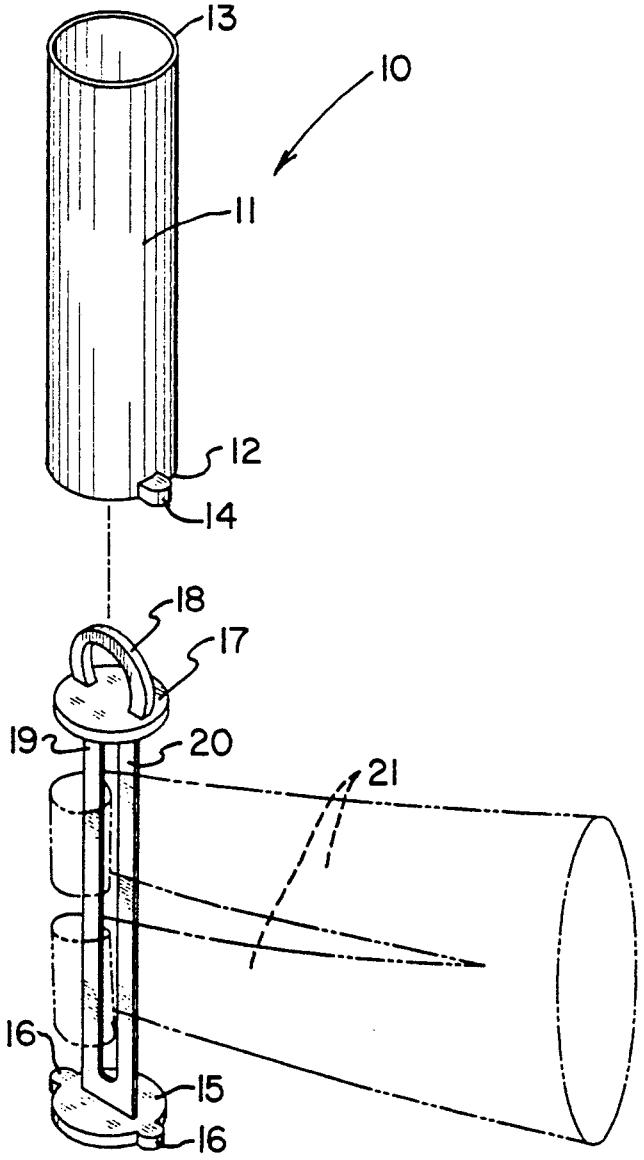
FIG. 1 is an isometric exploded view of the invention mounting a pantyhose pair within the spaced ribs of the insert.

With reference now to the drawings, and in particular to FIGS. 1 to 10 thereof, a new and improved pantyhose storage container embodying the principles and concepts of the present invention and generally designated by the reference numeral 10 will be described.

Figure 2:
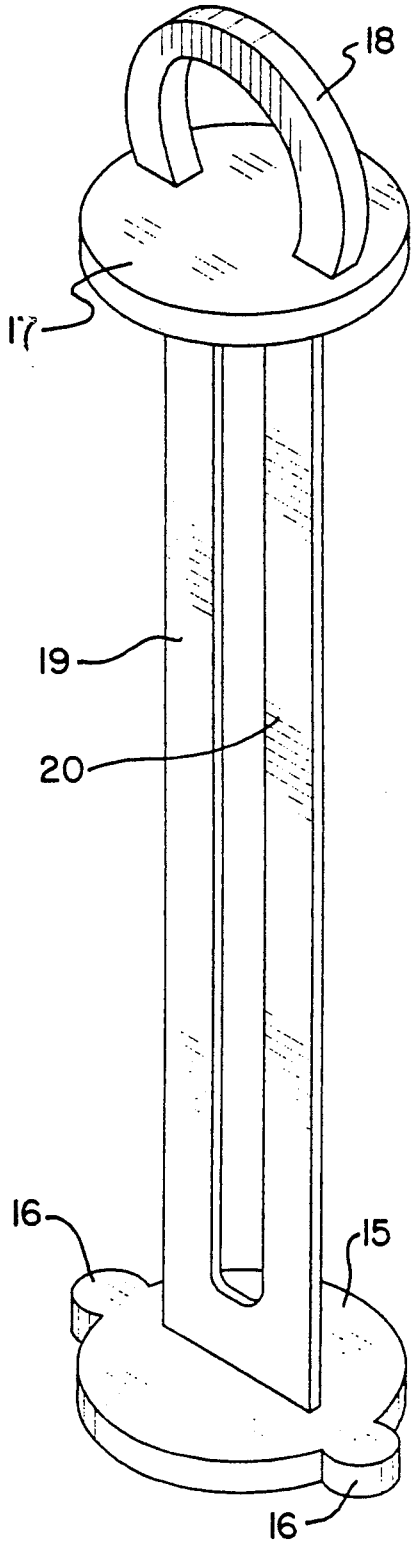
FIG. 2 is an enlarged isometric view of the insert.
Figure 3:
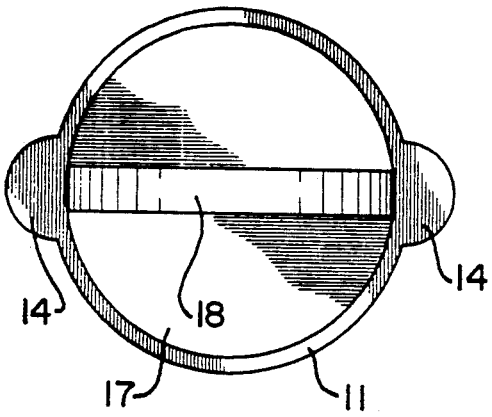
FIG. 3 is an orthographic top view of the insert positioned within the container.
Figure 4:
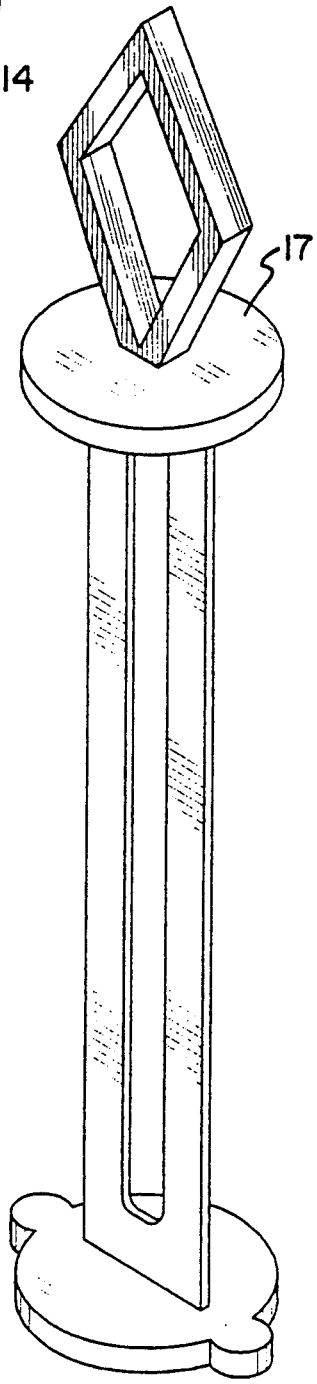
FIGS. 4 and 5 are isometric views of modified handle structure of the invention for distinguishing between various pantyhose pair.
Figure 5:
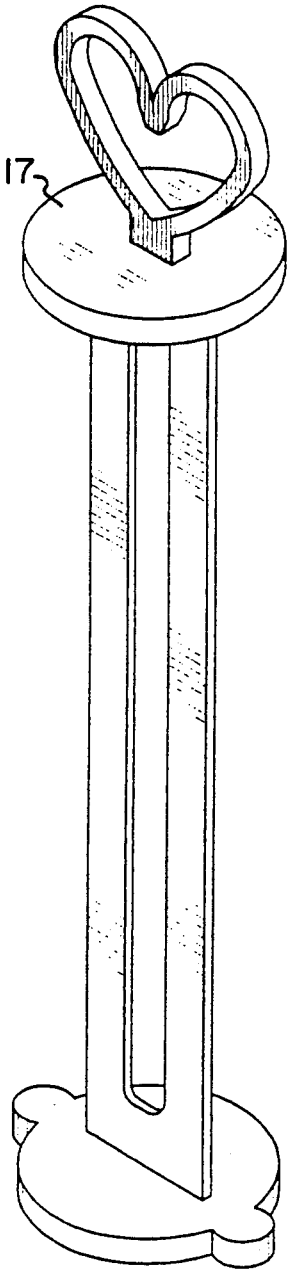

More specifically, the pantyhose storage container 10 of the instant invention essentially comprises a cylindrical storage housing 11, having a first end 12 spaced from a second end 13 spaced apart a predetermined spacing. A plurality of second end radially projecting cups 14 extend beyond the first end 12. An insert is provided, as indicated in FIG. 2, having respective first and second parallel plates 15 and 7 spaced apart the predetermined spacing of the first and second ends 12 and 13 for complementary reception within the housing 11, with the first plate 15 having radially projecting tabs 16, with one of said tabs 16 received within one of the cups 14 for frictional engagement within the cups for securement of the insert relative to the housing 11. A handle 18 is mounted to the second plate 17 for ease of manual manipulation of the insert relative to the housing, with first and second parallel ribs 19 and 20 orthogonally and fixedly mounted between the first and second plates 15 and 17 defining a gap therebetween to receive the legs 27 of a pantyhose pair, as indicated in FIG. 1, to permit furling of the pantyhose about the insert between the first and second plates 15 and 17. The FIGS. 4 and 5 further note the use of contrasting handle structure for use by the invention to provide for distinguishing among pantyhose pair that are received within separate housings, of a type as indicated in FIG. 1.

Figure 6:
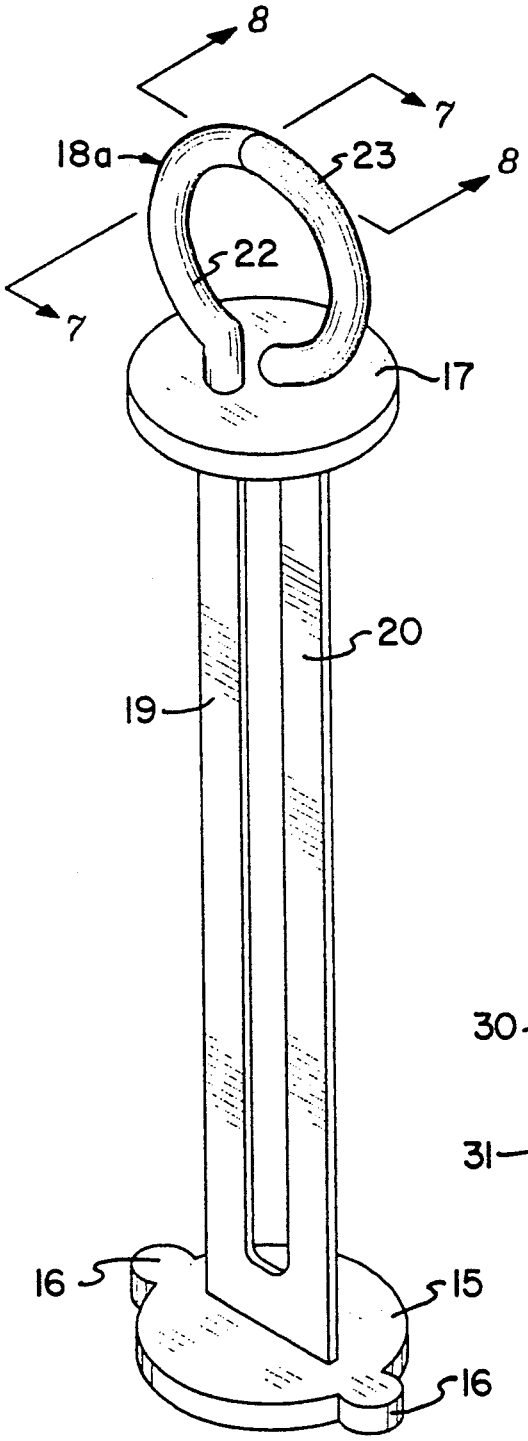
FIG. 6 is an isometric view of the insert having a modified handle structure.
Figure 7:
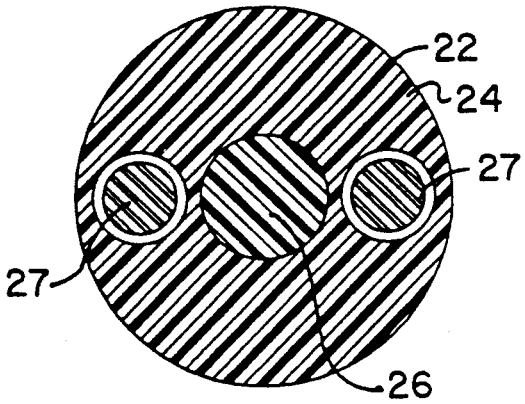
FIG. 7 is an orthographic view, taken along the lines 7—7 of FIG. 6 in the direction indicated by the arrows.
Figure 8:
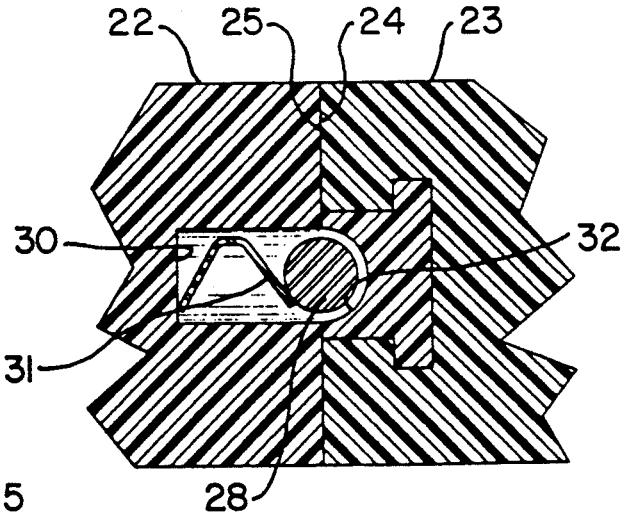
FIG. 8 is an orthographic view, taken along the lines 8—8 of FIG. 6 in the direction indicated by the arrows.

The FIGS. 6–8 indicates the use of a modified handle structure 18*a*, having a first semi-annular handle loop 22 extending from the second plate 17, with a second handle loop 23 rotatably mounted to the first handle loop to permit the second handle loop 23 to pivot one hundred eithty degrees relative to the first handle loop for use of the second handle loop as a hanger support about an associated rod and the like within a closet. The first handle loop 22 includes a first handle loop end wall 24 arranged for contiguous and rotatably communication relative to a second handle loop end wall 25. An axle shaft 26 extends coaxially between the first and second handle loop end walls 24 and 25. Locking spheres 27 are mounted on diametrically opposed sides of the axle shaft 26 positioned through the interface of the first and second handle loop end walls 24 and 25. The first handle loop end wall 24 includes a plurality of spring cavities 29, each receiving a locking sphere 27, with each spring cavity 29 having a spring cavity end wall 30, with a spring member 31 interposed between the spring cavity end wall 30 and a respective locking sphere 27. Each locking sphere accordingly is received within a semi-spherical socket 32 directed into the second handle loop end wall 25, in a manner as indicated in FIG. 8. In this manner, the handle loop is maintained in a first orientation, as indicated in FIG. 6, relative to a second orientation, wherein the second handle loop 23 is rotatably displaced one hundred eighty degrees relative to the first handle loop for use as a hanger structure.

Figure 9:
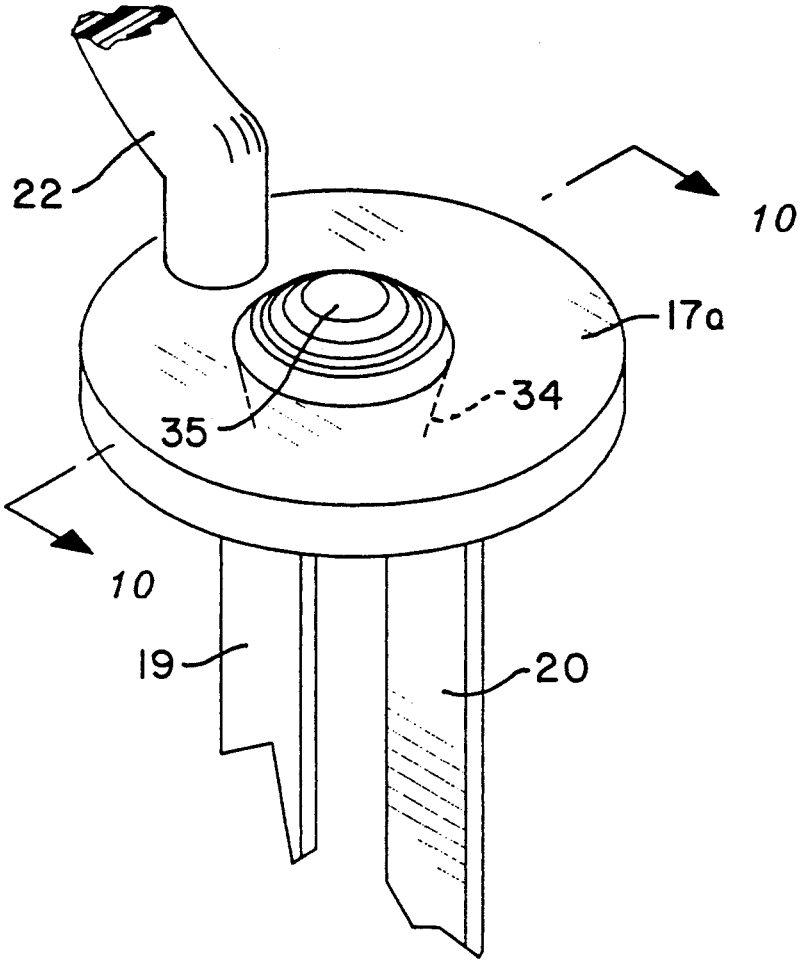
FIG. 9 is an enlarged isometric partial view of a modified second plate member.
Figure 10:
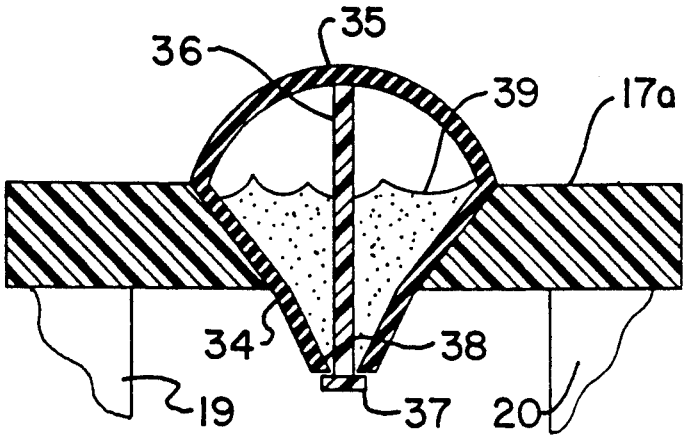
FIG. 10 is an orthographic view, taken along the lines 10—10 of FIG. 9 in the direction indicated by the arrows.

FIG. 9 indicates the use of a modified second plate 17, having a second plate conical aperture 33 directed therethrough projecting medially of the first and second ribs 19 and 20. The conical aperture 33 mounts a conical housing 34 therewithin, wherein the conical housing 34 has at a first end above the second plate, a semi-spherical resilient housing plunger wall 35, with a second end of the conical housing 34 having a housing exit port 38 positioned between the first and second ribs 19 and 20. A plunger wall rod 36 fixedly mounted to the plunger wall is directed medially of the conical housing 34 terminating in head 37 positioned exteriorly of the housing biased and in communication with the housing exit port 38. Upon pressing of the plunger wall 35, a deodorizing powder 39 contained within the conical housing 34 is projected between the first and second ribs 19 and 20 onto a pantyhose pair mounted between the first and second ribs 19 and 20 to maintain freshness and sanitizing of the pantyhose during storage and transport.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pantyhose storage container, comprising, a cylindrical storage housing, having a first end spaced from a second end spaced apart a predetermined spacing, the second end having radially projecting resilient cups, and an insert, the insert having a first plate spaced from and parallel to a second plate, with the first plate and second plate spaced apart said predetermined spacing, with the first plate having a plurality of lugs, with one of said lugs arranged for reception within one of said cups, and first and second parallel ribs extending orthogonally between the first plate and the second plate and fixedly mounted to the first plate and the second plate for reception of pantyhose between the first and second ribs for furling the pantyhose and storing the pantyhose within the storage housing, wherein the storage housing receives the insert, and a handle mounted to the second plate, and the handle includes a first loop rotatably mounting a second loop, the first loop mounted to the first plate and having a first loop end wall, the second loop having a second loop end wall in contiguous communication with the first loop end wall, the first loop end wall and the second loop end wall include an axle shaft extending coaxially of the first handle end wall and the second handle end wall permitting rotation of the first handle loop relative to the second handle loop.

2. A container as set forth in claim 1 including a plurality of spring cavities directed into the first handle loop extending from the first handle end wall, wherein each of the spring cavities includes a spring cavity end wall, and a locking sphere positioned within each spring cavity, and a spring member interposed between each locking sphere and a respective spring cavity end wall, and the second handle end wall having a plurality of semi-spherical sockets, wherein one of said sockets is arranged to receive one of said locking spheres permitting rotative displacement by the first handle loop relative to the second handle loop.

3. A container as set forth in claim 2 wherein the second plate has a second plate conical aperture directed medially thereof, and a conical housing projecting through the conical aperture extending between the first rib and the second rib, wherein the conical housing includes a semi-spherical resilient plunger wall positioned above the second plate, and an exit opening positioned below the plunger plate oriented between the first rib and the second rib, and a plunger wall rod fixedly mounted to the plunger wall extending through the conical housing and projecting from the housing exit opening, and wherein the plunger wall rod includes a rod head arranged for biased communication about the housing exit opening and permitting displacement of the rod head from the housing exit opening upon manual compression of the plunger wall towards the second plate, and powder contained within the conical housing for projection between the first rib and the second rib.

* * * * *